US010413018B2

(12) United States Patent
Kenison

(10) Patent No.: US 10,413,018 B2
(45) Date of Patent: Sep. 17, 2019

(54) FOOTWARE SECURING DEVICE

(71) Applicant: Emily Karal Kenison, New York, NY (US)

(72) Inventor: Emily Karal Kenison, New York, NY (US)

( * ) Notice: Subject to any disclaimer, the term of this patent is extended or adjusted under 35 U.S.C. 154(b) by 0 days.

(21) Appl. No.: 15/386,121

(22) Filed: Dec. 21, 2016

(65) Prior Publication Data

US 2017/0099912 A1 Apr. 13, 2017

Related U.S. Application Data

(63) Continuation-in-part of application No. 15/158,429, filed on May 18, 2016, now Pat. No. 10,159,299.

(60) Provisional application No. 62/163,266, filed on May 18, 2015.

(51) Int. Cl.

| | |
|---|---|
| ***A43C 11/24*** | (2006.01) |
| ***A43C 11/14*** | (2006.01) |
| ***A43C 19/00*** | (2006.01) |
| ***A43B 23/22*** | (2006.01) |
| ***A43B 3/12*** | (2006.01) |
| ***A43B 3/24*** | (2006.01) |

(52) U.S. Cl.

CPC ..... *A43C 11/14* (2013.01); *A43B 3/122* (2013.01); *A43B 3/126* (2013.01); *A43B 3/24* (2013.01); *A43B 23/227* (2013.01); *A43C 11/24* (2013.01); *A43C 19/00* (2013.01)

(58) Field of Classification Search

CPC ..... A43B 3/12; A43B 3/126; A43B 23/227; A43B 23/22; A43C 19/00; A43C 11/24

USPC ..... 36/58.5, 58.6, 136, 72 A, 7.6, 7.7

See application file for complete search history.

(56) References Cited

U.S. PATENT DOCUMENTS

| | | | | |
|---|---|---|---|---|
| 1,385,328 A | | 7/1921 | Louden | |
| 1,655,715 A | | 1/1928 | Sneeston | |
| 1,978,711 A | * | 10/1934 | Keely | E04D 15/00 36/113 |
| 2,588,919 A | * | 3/1952 | Gredell | A43C 13/02 36/113 |
| 2,616,189 A | * | 11/1952 | Smith | A43B 3/0078 36/1 |
| 2,628,437 A | | 2/1953 | Forsythe | |
| 2,972,823 A | | 2/1961 | Bailey | |
| 3,685,174 A | * | 8/1972 | Artle, Jr. | A01B 1/24 36/7.6 |
| 3,755,929 A | * | 9/1973 | Frisch | A43B 5/18 36/127 |

(Continued)

OTHER PUBLICATIONS

Supplementary European Search Report dated Apr. 26, 2019, for corresponding International Application No. 17800143.4, filed on Dec. 12, 2018, consisting of 8-pages.

*Primary Examiner* — Marie D Bays

(74) *Attorney, Agent, or Firm* — Gearhart Law LLC

(57) ABSTRACT

A footwear securing device is provided. The device includes a front strap, a mid strap, a rear strap, an ankle strap, a connector strap, and a base plate; the base plate configured to attach to a sole of a shoe and comprising a front portion, a mid portion, and a rear portion, the front portion comprising a front slot, the mid portion comprising a mid slot, and the rear portion comprising a rear slot; and the front strap configured to enter the front slot, the mid strap configured to enter the mid slot, and the rear strap configured to enter the rear slot.

5 Claims, 17 Drawing Sheets

(56) References Cited

U.S. PATENT DOCUMENTS 4,005,533 A * 2/1977 Anderson ..... A43C 15/065 36/62
4,817,302 A 4/1989 Saltsman
4,854,056 A * 8/1989 Levin ..... A43B 3/126 36/11.5
5,913,411 A * 6/1999 Spurling ..... A47G 25/90 2/232
7,398,607 B1 7/2008 Garcia et al.
7,614,126 B2 * 11/2009 Gerhardt ..... A43B 3/126 24/712
8,371,045 B2 * 2/2013 Tambay ..... A43C 15/09 36/113
2006/0059720 A1 3/2006 Phelan
2007/0209235 A1 * 9/2007 Brunelle-Wright .... A43B 3/122 36/50.1
2008/0010866 A1 * 1/2008 Mallamohamad ..... A43B 3/102 36/136
2010/0192337 A1 * 8/2010 LaPlante ..... A43B 3/0078 24/712
2010/0299960 A1 12/2010 Nyamuswa
2011/0154691 A1 6/2011 Mallamohamad
2012/0000096 A1 1/2012 Gonzalez
2012/0192459 A1 * 8/2012 Aderonke ..... A43C 11/24 36/136
2013/0326907 A1 * 12/2013 Ahanotu ..... A43B 23/00 36/58.6
2013/0333242 A1 12/2013 Whiting
2014/0259763 A1 * 9/2014 Rady ..... A43B 21/00 36/58.5
2014/0360054 A1 * 12/2014 Leslie ..... A43B 1/0054 36/136
2015/0033584 A1 * 2/2015 Ferguson ..... A43B 3/122 36/103
2017/0099912 A1 * 4/2017 Kenison ..... A43B 3/122

* cited by examiner

FOOTWARE SECURING DEVICE

CLAIM OF PRIORITY

This application claims priority under 35 U.S.C. § 119 to Provisional Application No. 62/163,266, filed on May 18, 2015 in the United States Patent and Trademark Office, and U.S. patent application Ser. No. 15/158,429, filed on May 18, 2016 in the United States Patent and Trademark Office, the entire disclosures of which is incorporated herein by reference.

FIELD OF THE EMBODIMENTS

This invention relates to footwear and, in particular, to footwear securing devices.

BACKGROUND OF THE EMBODIMENTS

Certain types of heeled women's shoes such as pumps, high-heels, mules, backless sandals, etc., have a tendency to slip off the heel of the foot. Differences in the size and shape of women's feet may make it difficult to find shoes that perfectly fit. This problem is further exacerbated at times when feet exude sweat, causing the foot to slip and slide inside the shoe. These problems make it difficult to walk and may cause injury such as sprains from the lack of stability. The free movement of feet in such instances may also cause blisters on the heel and other parts of the foot. Embodiments of the invention provide a mechanism for holding the foot in place within the shoe in situations where an imperfect fit or design of the shoe may cause the foot to become loose during use. Embodiments of the invention enable the wearer to wear shoes that are several sizes larger than the wearer's normal shoe size. This added support can also help prevent injuries to a person's leg or foot. The system is interchangeable with different shoes, and thus allows for wearers to change the appearance of their various shoes for stylistic purposes.

Embodiments of the invention are worn in pairs, one for the left foot and one for the right foot.

SUMMARY

A shoe strap assembly for women's shoes according to embodiments of the invention includes a base-plate which is positioned beneath the bottom of the shoe at the shank. Straps attached to the base-plate encircle the counter of a shoe and the upper/dorsal portion of a foot and a shoe, thus securely fastening the foot inside the shoe. The strap attached to the base-plate extends upwards from in between the shank and heel of the shoe forming a loop around the heel and longitudinally across the counter of the shoe. Two distinct ends extend towards the front of the shoe from in between the top of the counter and the seat of the shoe. The first end curves around outside (dorsal side) of the shoe having a buckle attached to it. The second end curves around the inside and across the upper portion of the shoe looping through the base plate and again over the outside portion of the shoe and attaching to the end. The removable strap mechanism will hold the foot against the up/down movement at the heel of the foot by exerting a downward pull on the top side of the foot.

The strap portion of an embodiment of the invention can be made from different materials including, but not limited to, leather, rubber, cloth, and/or plastic. Additionally, the strap portion can include hooks, buttons, snaps, buckles, loops and other mechanisms or attachments, which could be made of rubber, plastic, leather, jewels and/or metals. The base plate that is positioned under the sole of the shoe can be made of any flexible yet sturdy material, including, but no limited to metal (such as aluminum, copper, silver), plastic, rubber, and/or cardboard (such as bondex). Additionally, this base plate can be covered with different materials including, but not limited to, leather, rubber, cloth, and/or plastic, or attachments, which could be made of plastics, jewels, and/or metals.

The base plate, which is positioned under the sole of the shoe, is in the shape of a malleable curve. The base plate can bend to fit the various inclines/arches that result from different heel heights. The base plate can come in various lengths, but will remain short enough so that it does not reach the ball of the foot. One end of the base plate is positioned at the point where the heel meets the sole of the shoe. The other end may extend along the heel toward the tip. The straps that cover the top of the feet are attached to the base plate which is positioned under the sole of the shoe using elastic, which allows for a slip-on application for wearers, or a loop mechanism, which allows for the wearer to self-adjust the fit of the straps. However, the straps can also be attached to the baseplate that is positioned under the sole of the shoe using other mechanisms, including, but not limited to, hooks, buttons, snaps, hook and loop fasteners, and/or buckles. The loop that is positioned around the heel can be attached directly to the base plate that is positioned under the sole of the shoe, or can attach directly to the straps.

According to an embodiment of the present invention, a footwear securing device is provided. The footwear securing device includes a strap and a base plate, the base plate configured to attach to a shank of a shoe, and the strap configured to be securedly coupled to the base plate.

According to another embodiment of the present invention, a footwear securing device is provided. The footwear securing device includes a front strap, a mid strap, a rear strap, an ankle strap, a connector strap, and a base plate, the base plate configured to attach to a sole of a shoe, and the front strap, the mid strap, and the rear strap being configured to be coupled to the base plate.

According to yet another embodiment of the present invention, a footwear securing device is provided. The footwear securing device includes a counter strap and a foot strap, a securing mechanism coupled to a shoe, the counter strap comprising a distal end and a proximal end, the foot strap comprising a distal region and a proximal region, a distal end of the counter strap attached to the distal region of the foot strap, and a proximal end of the counter strap attached to the proximal region of the foot strap, the foot strap configured to encircle a dorsal portion of a foot, the foot strap configured to encircle a shank portion of a shoe, and the counter strap and the foot strap being configured to be coupled to the securing mechanism.

DESCRIPTION OF THE PREFERRED EMBODIMENTS

Figure 1:
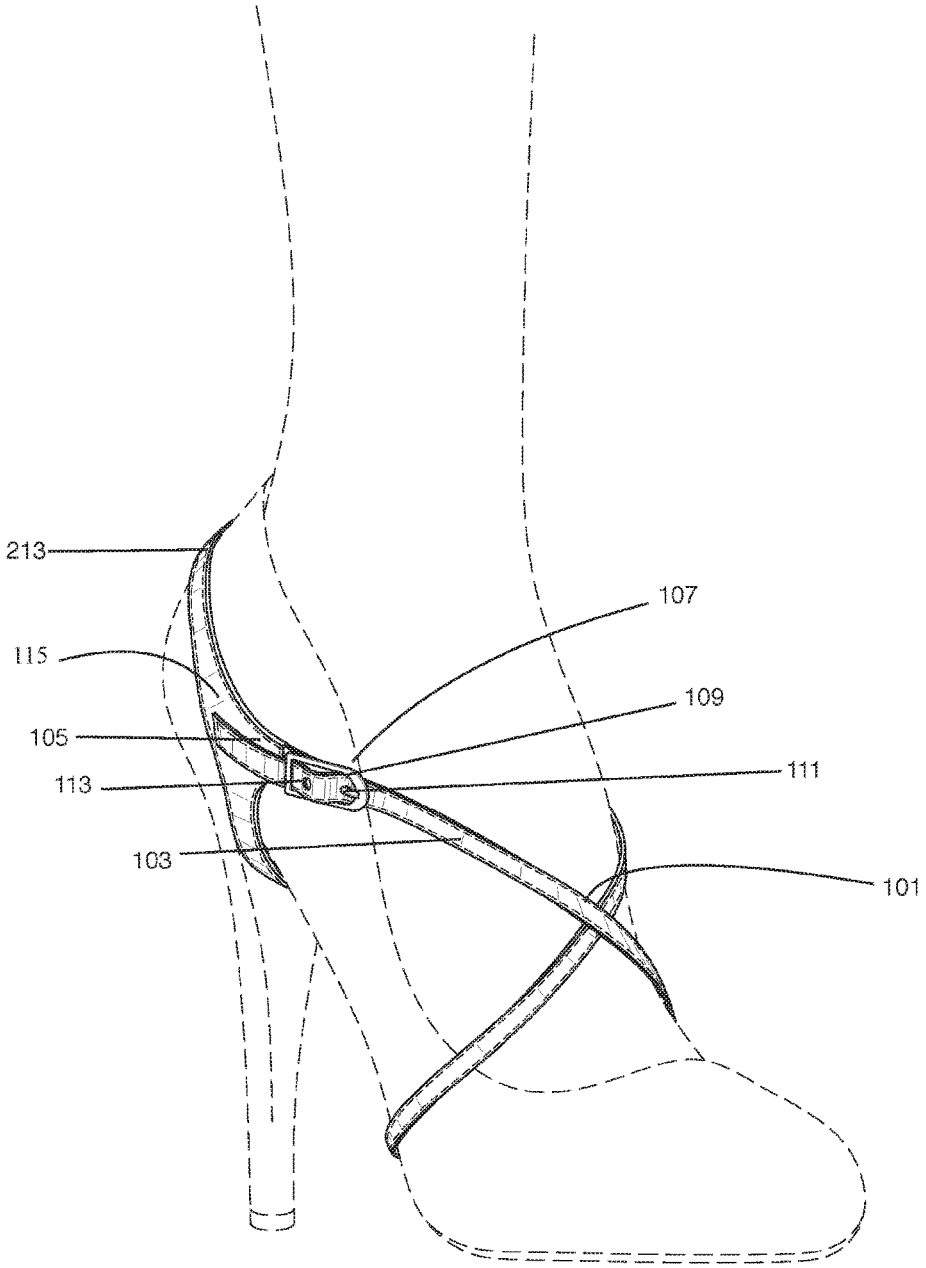
FIG. 1 is a front perspective view of a right foot configuration of an embodiment of the invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 2:
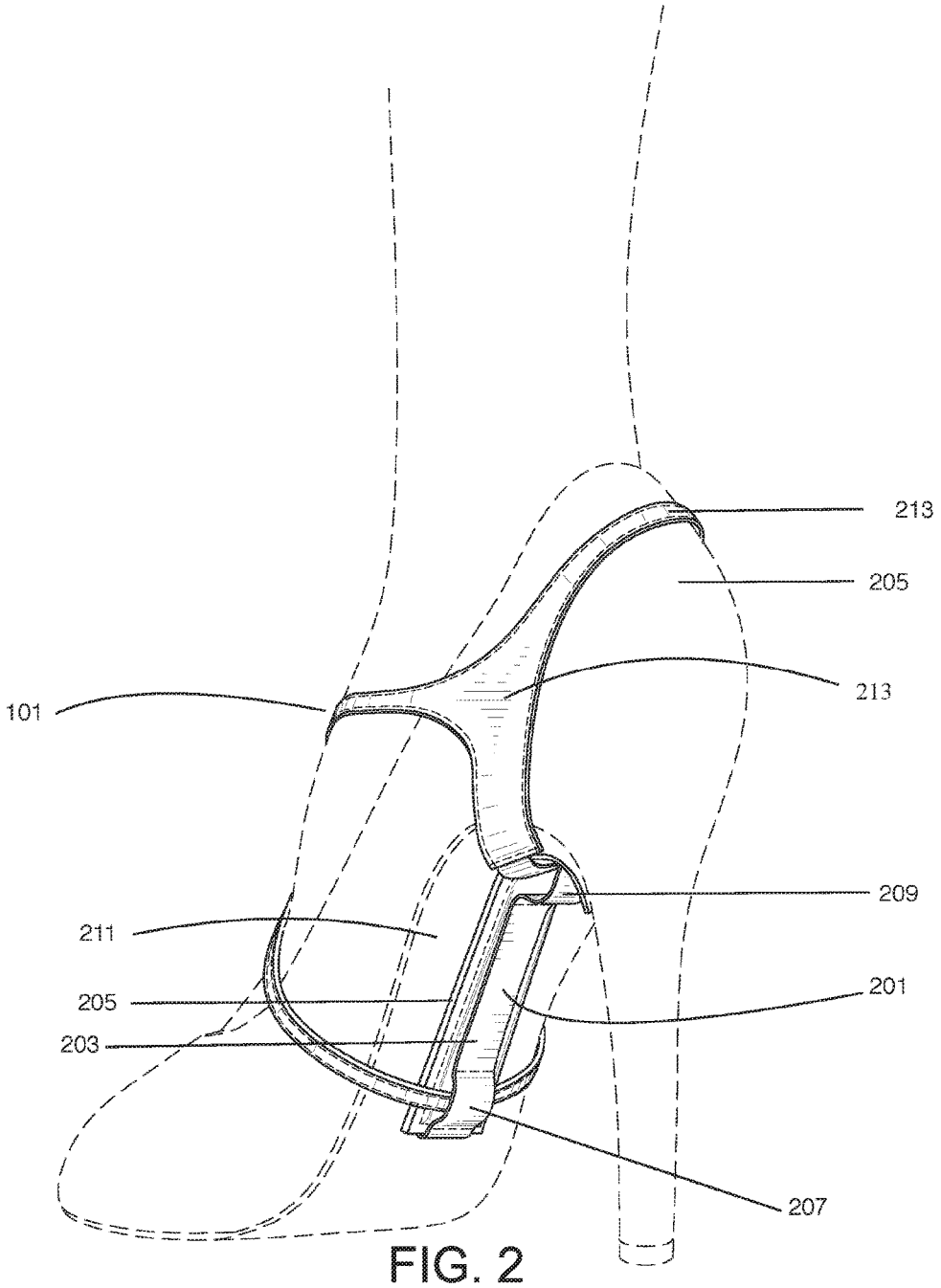
FIG. 2 is a rear perspective view of a right foot configuration of an embodiment of the invention.

The present invention is related to a detachable shoes strap system designed to secure a loose fitting heeled shoe to a user's foot during normal wear. FIG. 1 shows a front perspective view of a right foot configuration of one embodiment as it would appear on a shoe and user's foot during use. FIG. 2 shows a rear perspective view of the same embodiment as above. In this embodiment, the strap system primarily comprises of a main-strap 101 which encircles a foot and shoe during use and the base plate 201 which is positioned against a sole of a shoe. The base plate anchors the main strap at designated positions around a shoe and foot. Thus, in conjunction with the main strap, the base plate holds a foot in place against movement within a shoe.

As illustrated in FIG. 2, the base plate 201 comprises a top member 203 and a bottom member 205, which are permanently attached to one another. In the alternative top member 203 and bottom member 205 may be releasably attached. These members can come in various lengths, but will remain short enough so that they do not reach the ball of a shoe. The top and bottom members 203 and 205 can be attached to one another with glue or similar adhesive substance or they can be sewn together. The top member 203 further comprises a front base plate slot 207 and a rear base plate slot 209 where the top member 203 is not attached to the bottom member 205 as shown in FIG. 2. Instead, the top member 203 and bottom member 205 form openings through which the main strap 101 can pass through. During use, the bottom member 205 would be positioned against the shank 211 of a shoe, thus allowing the main strap 101 to pass through the base plate slots at designated points. A counter loop 213 extends from the main strap 101. The rear slot 209 may hold a portion of the main strap 101 from which the counter loop 213 extends, thereby securing the counter loop 213 at the rear of a shoe. The front slot 207 may provide a means for holding a proximal-end 103 of the main strap 101 at a position located at the front of a shoe.

The base plate can be made of any flexible yet sturdy material, including, but not limited to metal (such as aluminum, copper, silver), plastic, rubber, and/or cardboard (such as bondex). Additionally, the base plate can be covered with different materials including but not limited to leather, rubber, cloth, and/or plastic or attachments, which could be made of plastics, jewels, and/or metals, for secondary ornamental purposes.

Figure 4:
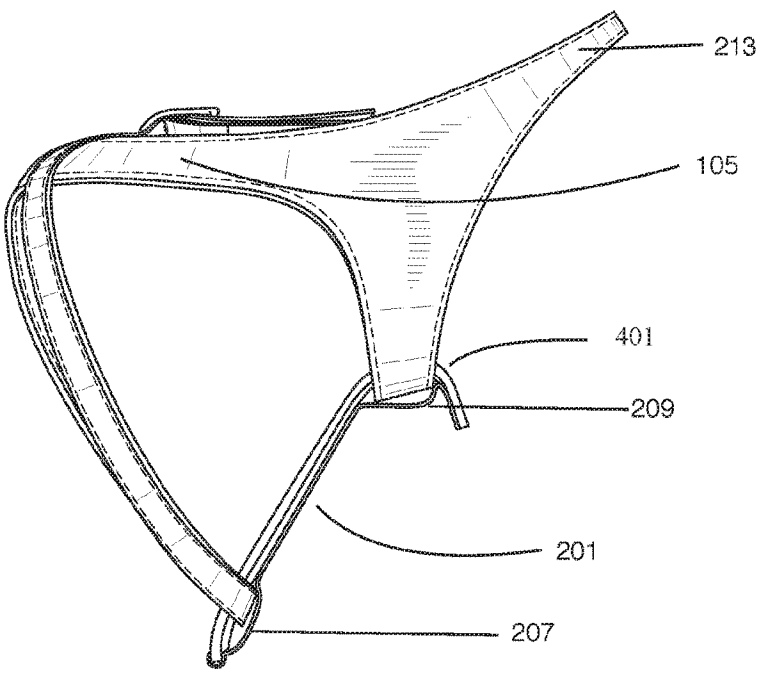
FIG. 4 is a proximal perspective view of an embodiment of the invention.
Figure 3:
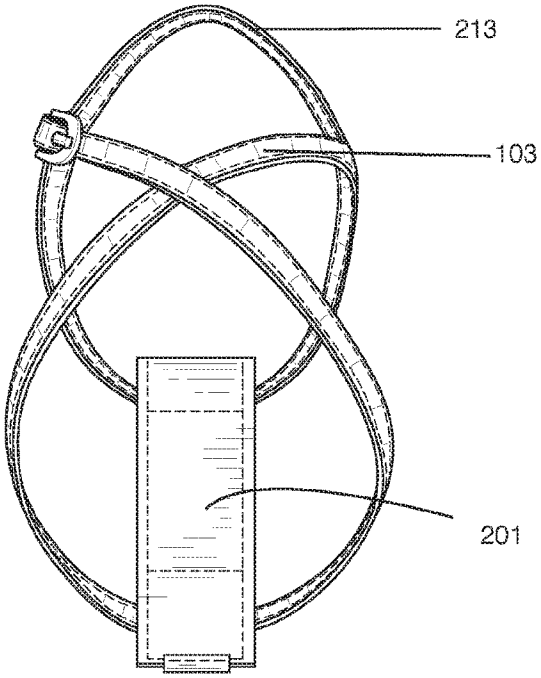
FIG. 3 is a front perspective view of an embodiment of the invention.

FIG. 3 shows a proximal perspective view of an embodiment of the securing device as it stands alone without a user's shoe and foot. As illustrated in FIG. 4 the base plate 201 is curved at the rear approximately where the rear base plate slot is located (approximately being within 115 millimeters). This base plate curve 401 is malleable and during use rests approximately at the intersection of a heel and sole. The malleable feature of the base plate curve 401 allows it to bend to fit the various inclines and arches that result from different heel heights.

As further illustrated in FIG. 2, the main strap 101, when properly positioned on a user's shoe extends upwards from the rear base plate slot 209 across the distal and proximal sides of a shoe. Approximately one half of the distance across the counter, the main-strap 101 bifurcates extending upwards to form a loop around the counter 205 of a shoe, and toward the front of a shoe to form two distinct ends. The two ends formed are the distal-end 105 on the distal side 115 and the proximal-end 103 on the proximal side 113 of a shoe.

Figure 6:
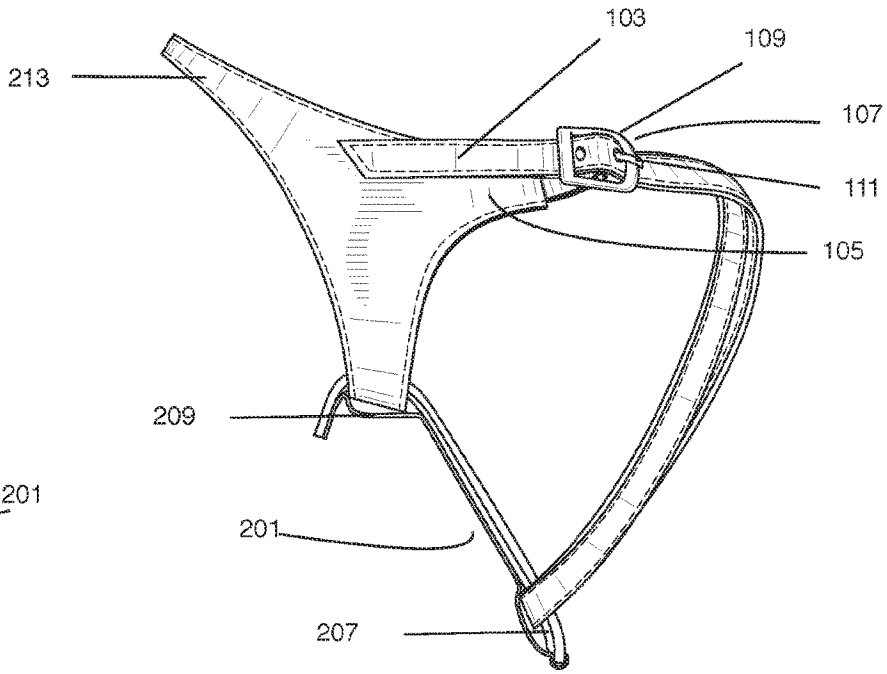
FIG. 6 is a distal perspective view of an embodiment of the invention.
Figure 5:
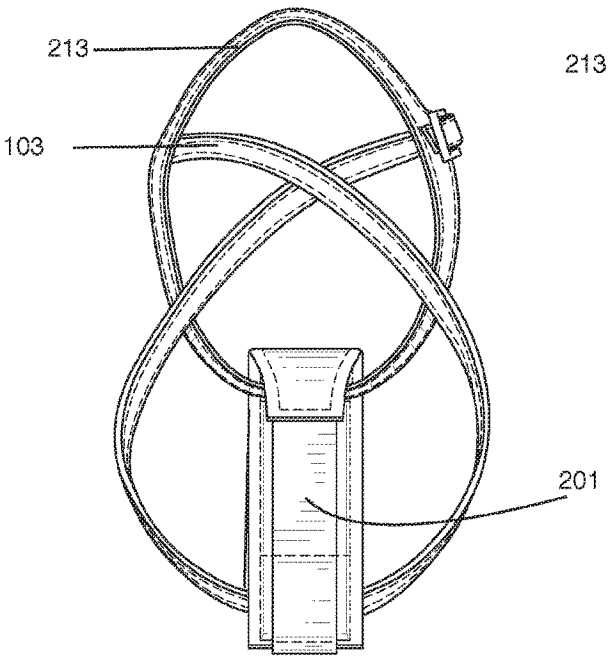
FIG. 5 is a rear perspective view of an embodiment of the invention.
Figure 8:
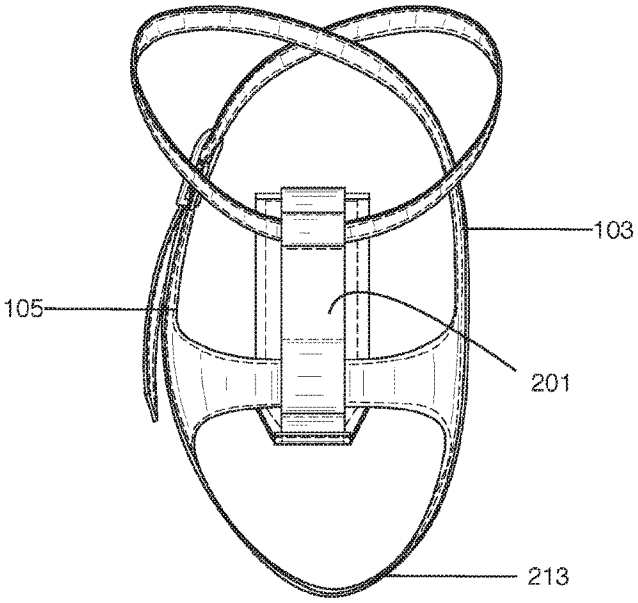
FIG. 8 is a bottom plan perspective view of an embodiment of the invention.
Figure 7:
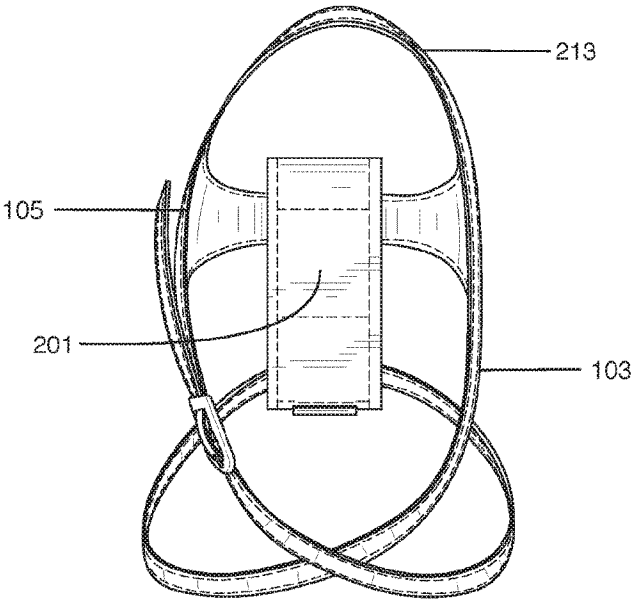
FIG. 7 is a top plan perspective view of an embodiment of the invention.

As depicted in FIG. 1, the two distinct ends, the proximal-end 103 and the distal-end 105 can be joined at the distal side 115 of a shoe, approximately where a user's ankle would rest. Attached to the distal-end is a buckle 107 comprising a frame 109 and a buckle-prong 111 that is permanently attached to the frame. The proximal-end 103 comprises adjuster holes 113 which provide attachment points for the buckle-prong 111 thus allowing a user to connect the two ends. During use, the proximal-end 103 and distal-end 105 are used to tighten the main strap 101 around a shoe and a user's foot and to firmly hold a foot within a shoe during use. The main strap 101 can be tightened around a user's foot by pulling the proximal-end 103 toward the back of a shoe and securing the buckle-prong 111 to successive adjuster holes 113 positioned away from the proximal-end 103. FIG. 6 shows the distal side view of the above proximal-end 103 and distal-end 105.

Thus, during use, the main-strap 101 encircles the top of a user's foot as well as the counter 205 and the shank 211 of a user's shoe thereby firmly securing a user's foot in place within a user's shoe. As shown in FIG. 3, the proximal-end 103 extends diagonally from the proximal side of a shoe towards the front and distal end of a shoe wrapping over the superior/dorsal portion of a foot. As it continues to extend, the proximal-end 103 of the main-strap 101 travels through the front base plate slot 207 situated toward the front of a user's shoe. After passing through the front base plate slot 207, the proximal-end 103 extends diagonally in the posterior direction toward the ankle portion and distal side of the shoe. The main strap 101 can be made from different materials including, but not limited to, leather, rubber, cloth, and/or plastic. The material should be able to stretch while remaining resilient in order to provide the necessary support for a foot during use.

Figure 9:
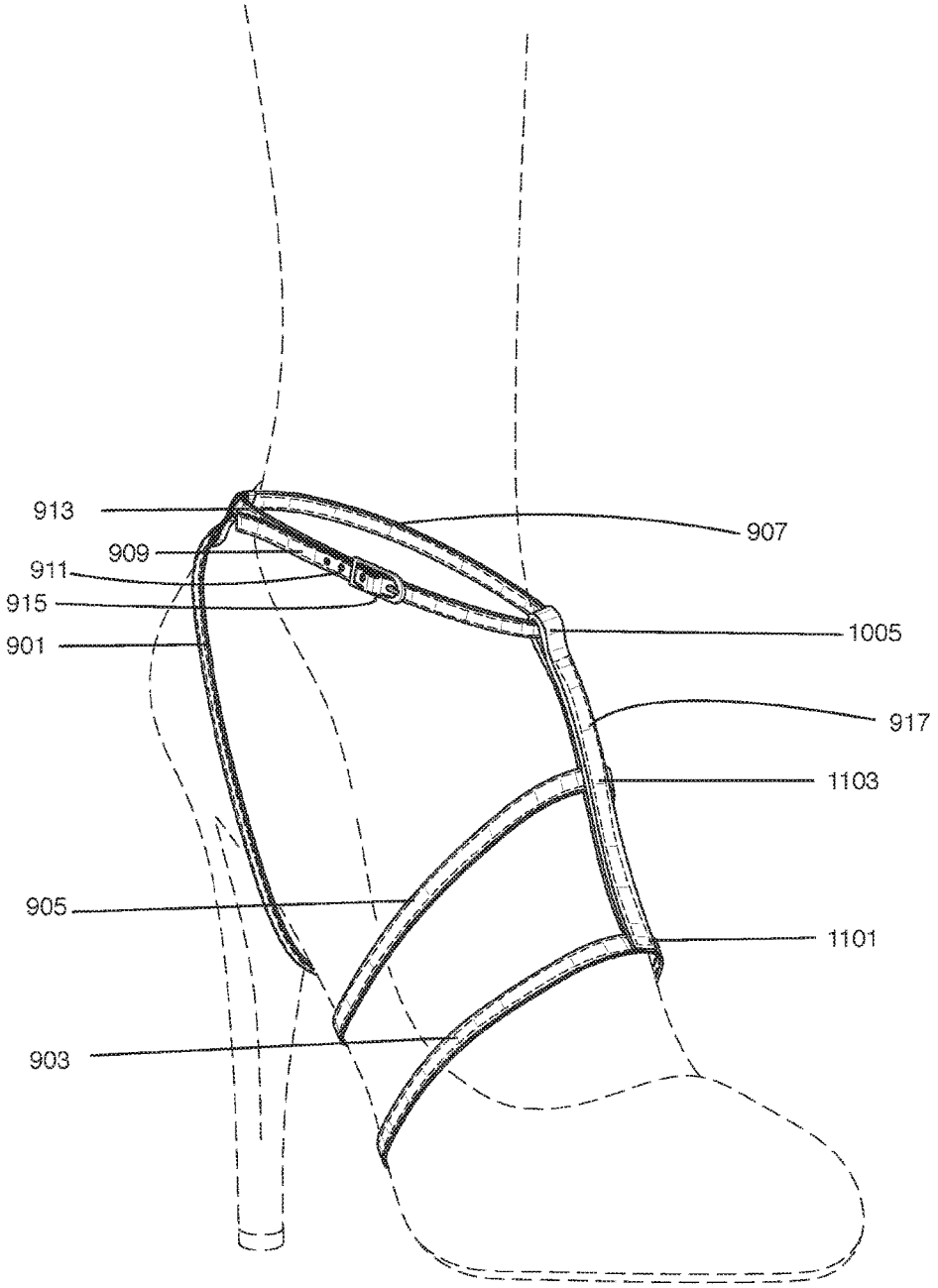
FIG. 9 is a front perspective view of a right foot configuration of an embodiment of the invention.

Another embodiment of the device is depicted in FIGS. 9-16. In FIG. 9 the securing device in a right foot configuration is shown as it would appear on a user's shoe and foot during use. In this embodiment, additional independent straps further aid in securing the foot firmly to the shoe. The additional straps also aid in use with additional styles of heeled shoes such as open toed shoes.

As depicted in FIG. 9, this embodiment comprises four main straps that encircle a user's shoe and foot, a counter strap 901, front-strap 903, mid strap 905, and an ankle-strap 907. An additional strap, the top-strap 917, runs vertically across the dorsal side of a user's foot and provides anchoring points for the front-strap 903, mid-strap 905, and ankle-strap 907 at three separate points. The ankle-strap further comprises two distinct ends, a proximal-end 909 comprising adjuster holes 911 and a distal-end 913 comprising a buckle 915. The ankle-strap 907 can be tightened around a user's ankle by joining the buckle 915 and adjuster holes 911 as previously described.

Figure 10:
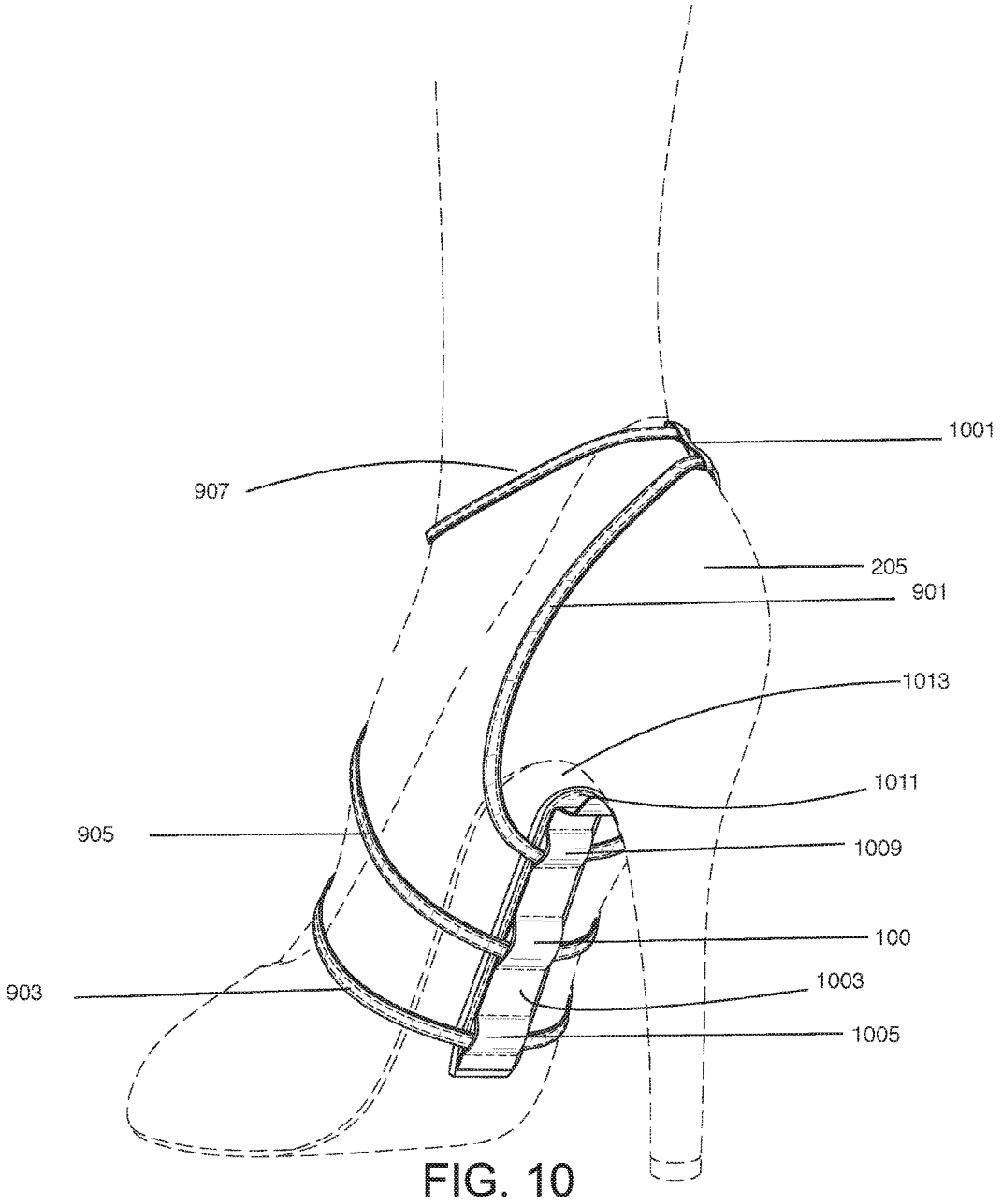
FIG. 10 is a rear perspective view of a right foot configuration of an embodiment of the invention.
Figure 12:
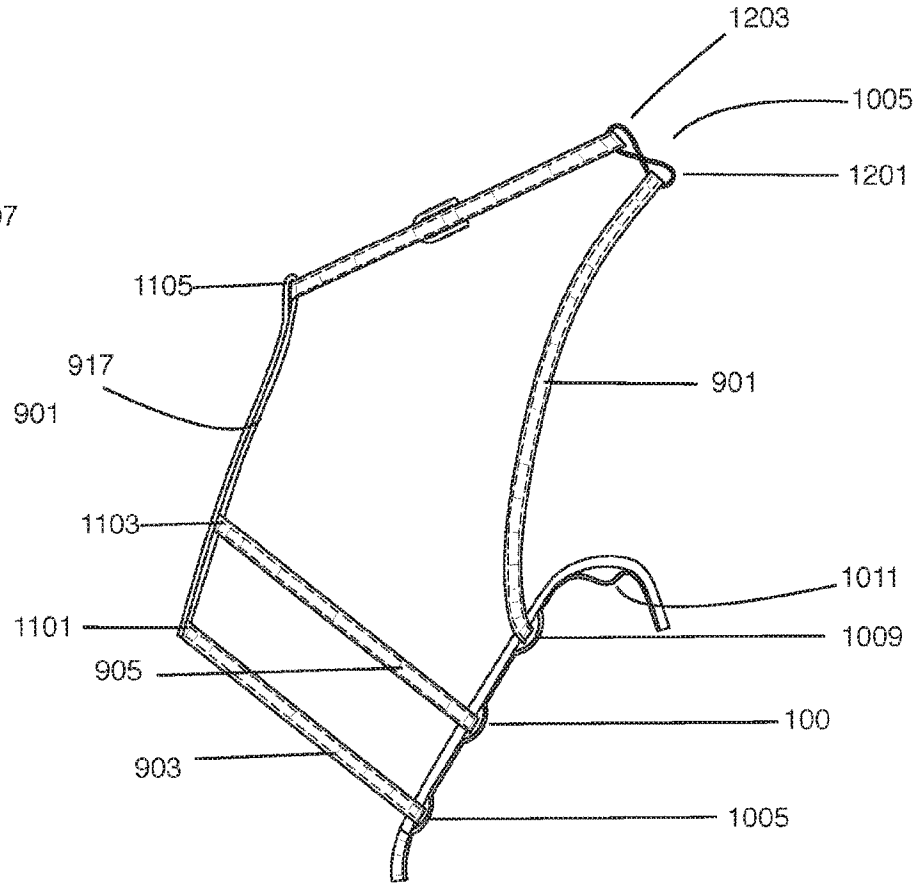
FIG. 12 is a proximal perspective view of an embodiment of the invention.
Figure 14:
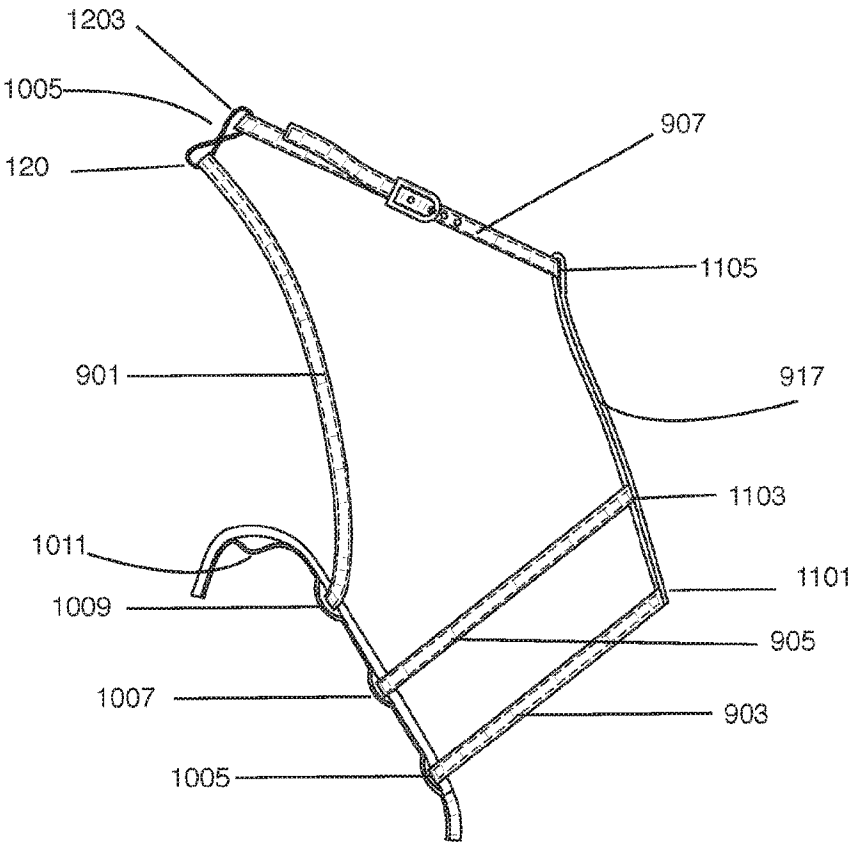
FIG. 14 is a distal perspective view of an embodiment of the invention.

FIG. 10 illustrates the bottom perspective view of the securing device, as it would appear on a user's shoe and foot during use. As seen in FIG. 10 the securing device comprises a connector strap 1001 which provides an anchoring position for the counter strap 901 and ankle strap 907 at the counter 205 of a shoe. FIG. 12 shows a proximal side view of the securing device, as it stands alone without a user's shoe and foot. As illustrated in FIG. 12 the connector-strap 1001 comprises a bottom connector loop 1201 for securing the counter strap 901 and a top connector loop 1203 for securing the ankle strap 907. FIG. 14 shows a distal side view of the same embodiment above.

FIG. 10 further illustrates a modified baseplate 1003 underlying a shoe. As before, the modified baseplate 1003 is comprised of a top member and bottom member which are permanently attached to one another. However, the modified baseplate 1003 here comprises a front base plate slot 1005, rear base plate slot 1009 and an additional mid base plate slot 1007 to accommodate the mid-strap mentioned above. Additionally, in this embodiment, the rear base plate slot 1009 is positioned on the flat portion of the base plate in front and away from the curved portion 1011 and the apex 1013 of a shoe. This modified base plate is particularly beneficial when used with shoes that have a heel with unusual dimensions or in shoes where a heel is placed on a non-traditional part of a sole or in a non-traditional angle. This allows the curved portion 1011 to adjust to non-traditional angles of the apex or heel portion of a shoe while still allowing the counter strap 901 to encircle the counter 205 at the desired angle (not pictured here).

According to an embodiment, the baseplate 1003 can include a wide range of materials such as, e.g., sturdy elastic, hard plastic, metal, etc.

Figure 11:
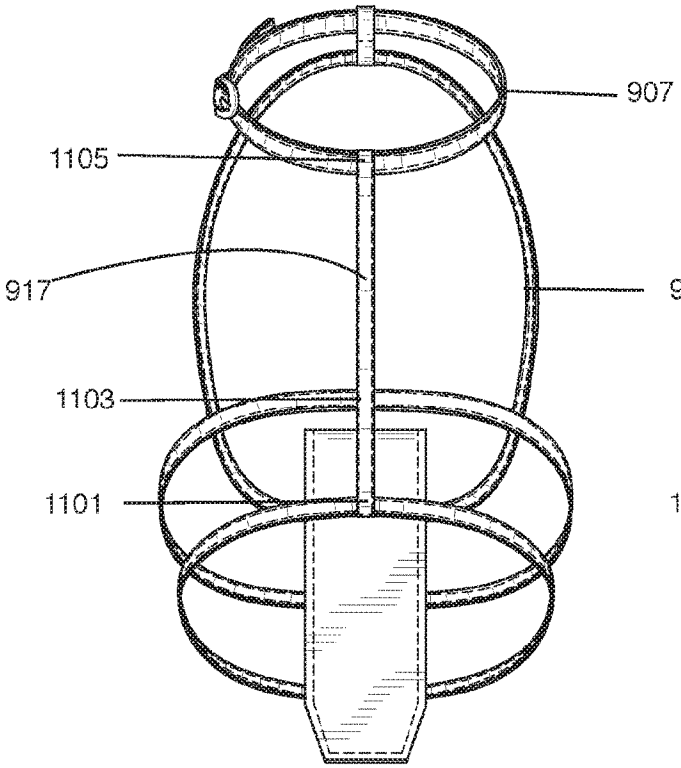
FIG. 11 is a front perspective view of an embodiment of the invention.
Figure 13:
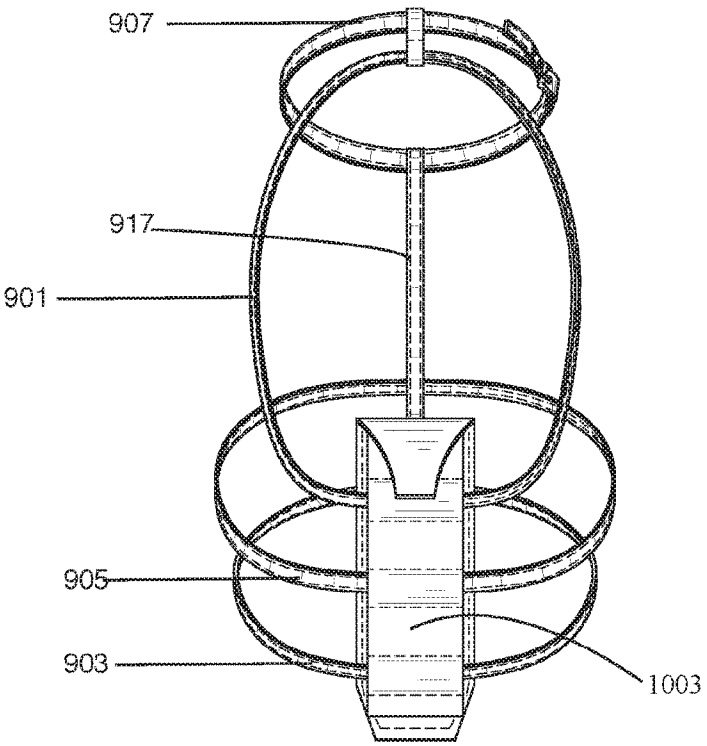
FIG. 13 is a rear perspective view of an embodiment of the invention.

FIG. 11 shows the front perspective view of the securing device as it stands alone without a user's shoe and foot. As seen in FIG. 11, the front strap 903 is permanently attached in a perpendicularly fashion to the top-strap 917 at the front region 1101 while the mid-strap 905 is similarly attached to the top strap 917 at mid-region 1103. The top-strap further comprises a slot at the loop-region 1105 allowing the ankle-strap 907 to pass through the top-strap and anchor the ankle-strap at that position. The loop slot interface 1105 allows a user to adjust the tightness of the ankle strap without moving the top strap 917 from its ideal position on dorsal side of a user's foot. FIG. 9 further illustrates the loop-interface 1005. FIG. 13 shows the rear perspective view of the securing device as it stands alone without a user's shoe and foot.

Figure 16:
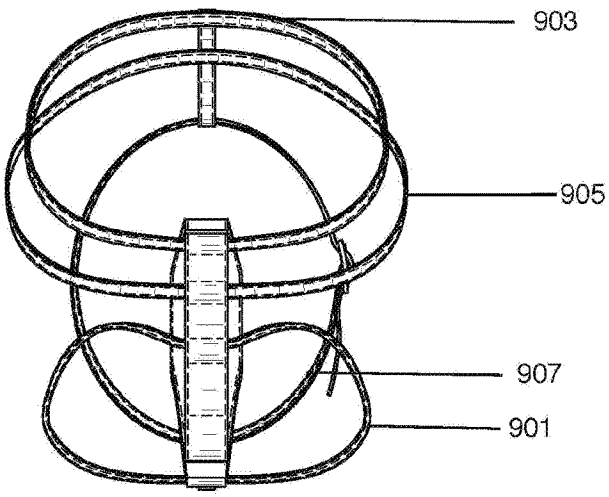
FIG. 16 is a bottom plan perspective view of an embodiment of the invention.
Figure 15:
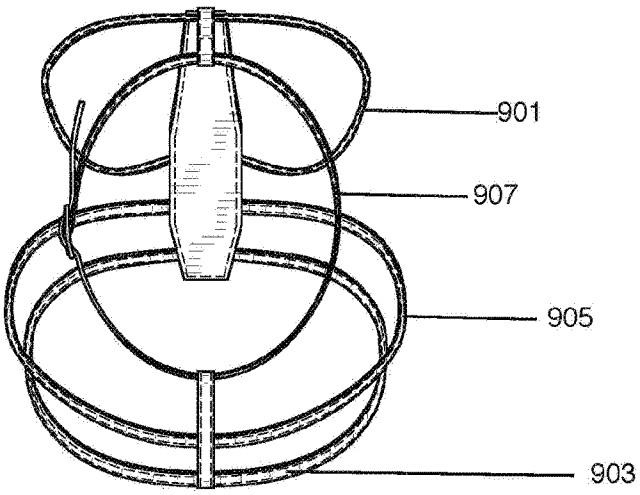
FIG. 15 is a top plan perspective view of an embodiment of the invention.

FIG. 15 shows a top perspective view of the securing device as it stands alone without a user's shoes and foot. The front and mid straps can be attached to the base plate using elastic or a similar material, allowing for a slip-on application for a user. The straps above could also be attached to the base plate with a loop mechanism which would allow a user to self-adjust the tightness of the straps. Furthermore, the straps above can also be attached to the base plate using other mechanisms, including, but not limited to, hooks, buttons, snaps, and/or buckles. The loop that is positioned around the heel can be attached directly to the base plate that is positioned under the sole of the shoe, or can attach directly to the straps. FIG. 16 shows the bottom perspective view of the same embodiment above.

Figure 17:
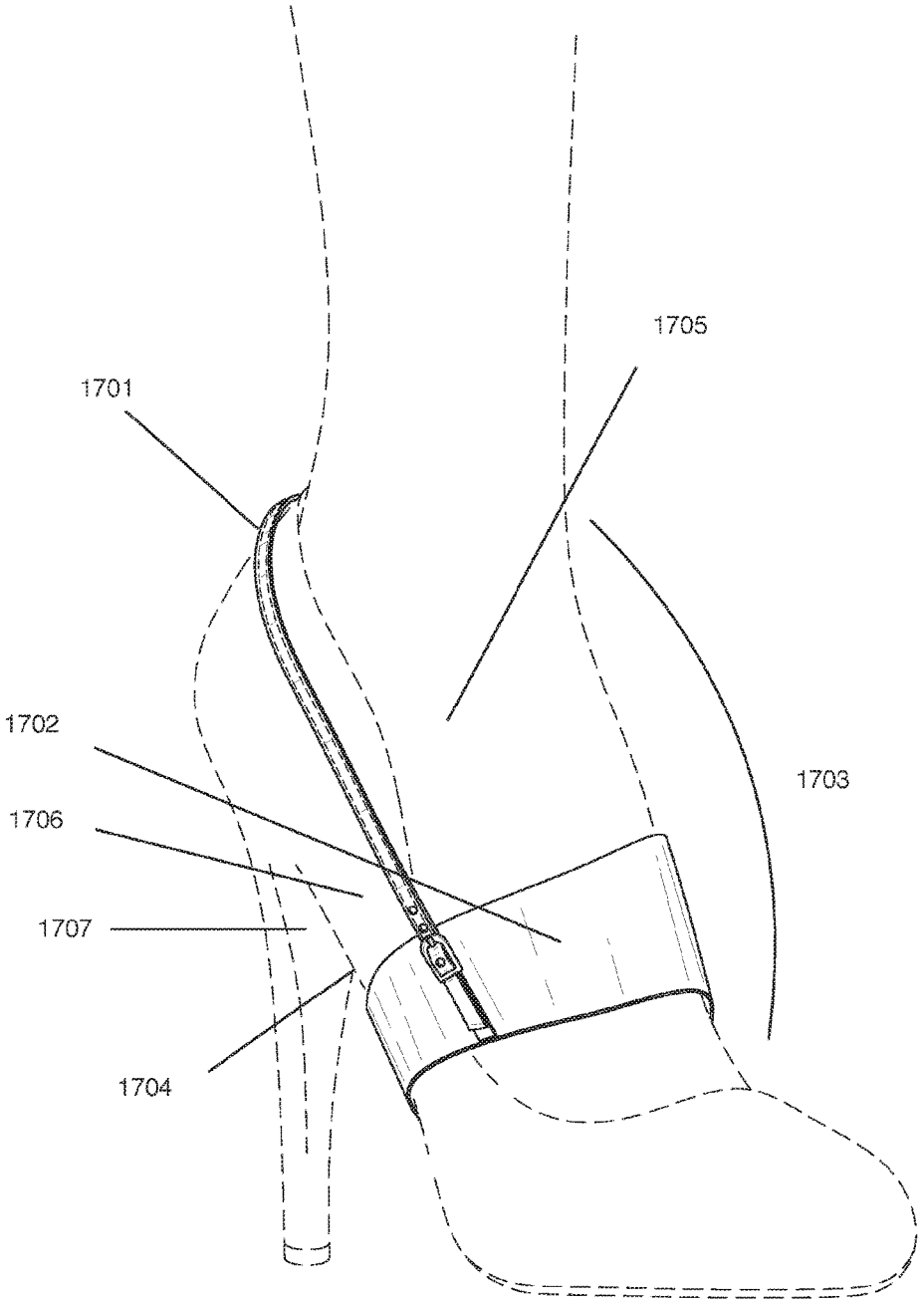
FIG. 17 is a front perspective view of an embodiment of the invention.

A third embodiment of the shoe strap system is depicted in FIGS. 17-24. In FIG. 17, the strap system is shown in the front perspective as it would appear on a user's shoe and foot during use. In this embodiment, the strap system may include a counter strap 1701 and a foot strap 1702. The counter strap 1701 wraps around the user's ankle but does not enclose the entire ankle. The foot strap 1702 wraps around the shoe's upper 1703 and shank 1704, enclosing the dorsal side 1705 and plantar side 1706 of the foot.

Figure 18:
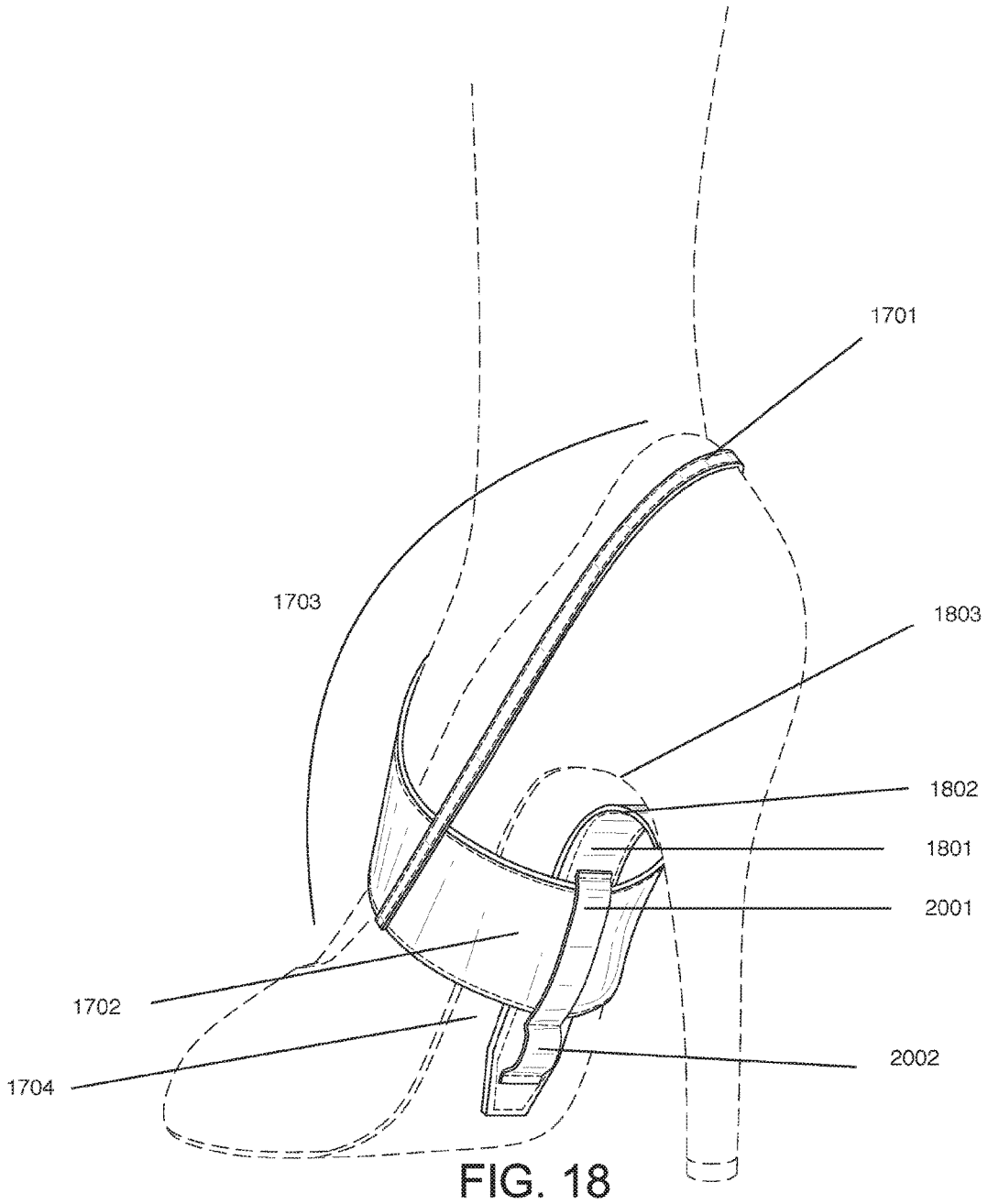
FIG. 18 is a rear perspective view of an embodiment of the invention.

FIG. 18 depicts a rear perspective view of the footwear securing device as it would appear on a user's shoe and foot during use. As seen in FIG. 18, the base plate 1801 may be curved at the top end 1802 to conform to the shape of the shank 1704 and the pitch 1803. In another embodiment, the base plate 1801 may be straight and conform to just the shape of the shank 1704.

Figure 21:
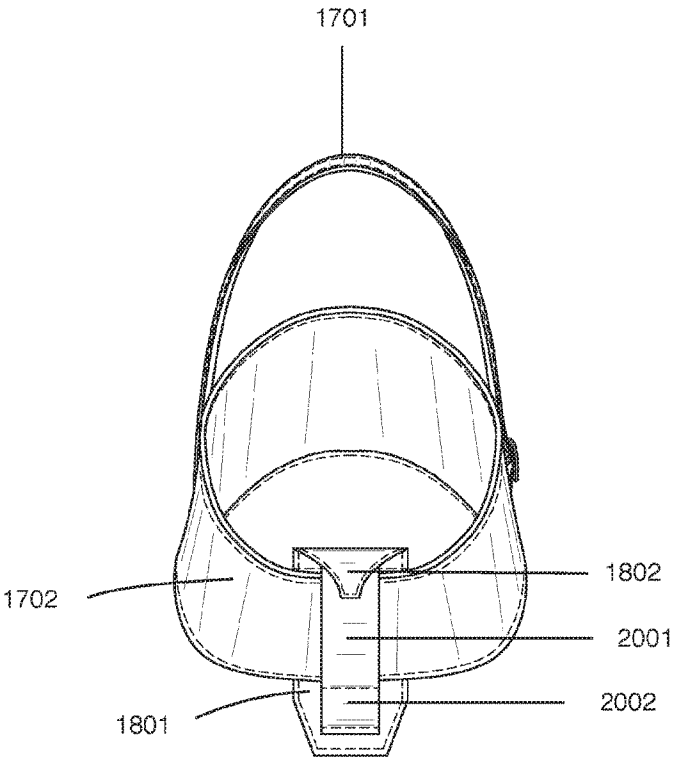
FIG. 21 is a rear perspective view of an embodiment of the invention.

FIG. 21 shows the rear perspective view of the footwear securing device as it stands alone without the user's shoe and foot. As seen in FIG. 21, the base plate 1801 may be located on the centered lower half of the foot strap 1702. The base plate 1801 may comprise a slot 2001 and the foot strap 1702 may be insertable through the slot 2001. The size of the slot may vary depending on the size of the foot strap 1702. In one embodiment, the base plate may have more than one slot. For example, a second slot 2002 may be useful if the user decides to add another strap to the strap system.

Figure 19:
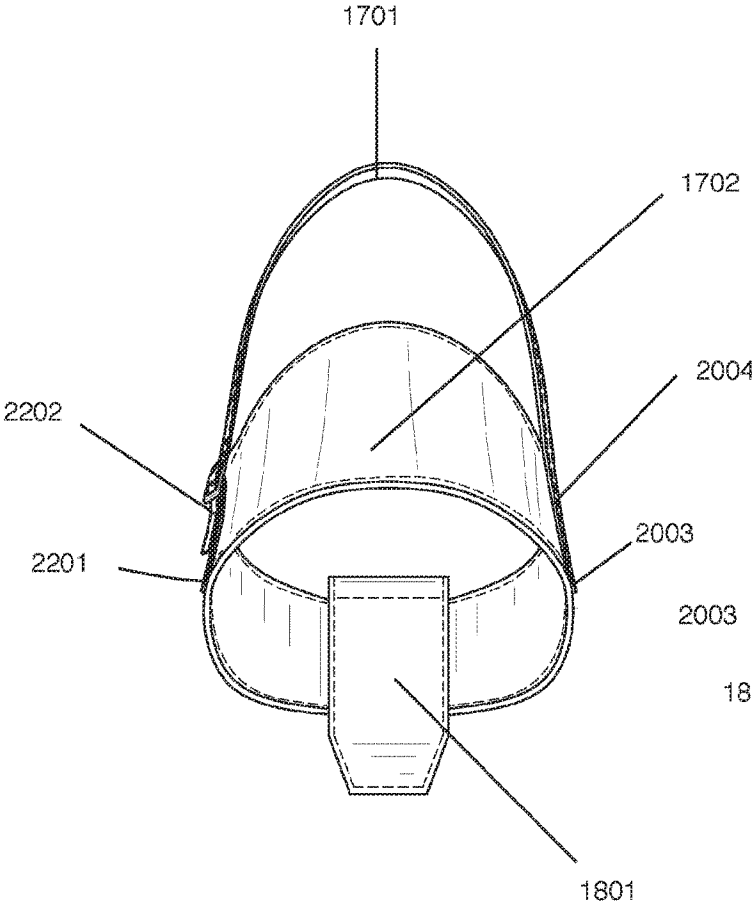
FIG. 19 is a front perspective view of an embodiment of the invention.

FIG. 19 shows the front perspective view of the footwear securing device as it stands alone without the user's foot and shoe. The foot strap 1702 may vary in width. For example, the foot strap 1702 may be one to three inches wide, or even longer, thus covering most of the upper 1703 of the user's shoe. In another embodiment, the foot strap 1702 may be one inch wide or less. The various widths are advantageous for multiple reasons. First, it can provide a cover for shoes that normally expose the dorsal side 1705 of the foot. Second, such a cover can provide warmth or protection from the sun. And lastly, securing the entire dorsal side 1705 may provide comfort or more stability in the shoe.

The width of the foot strap may be uniform throughout the entire foot strap 1702. In another embodiment, the width of the foot strap may be different at various points of the foot strap 1702. This is advantageous for the user whose shoe may better conform to a foot strap with a certain width better in certain locations.

Figure 20:
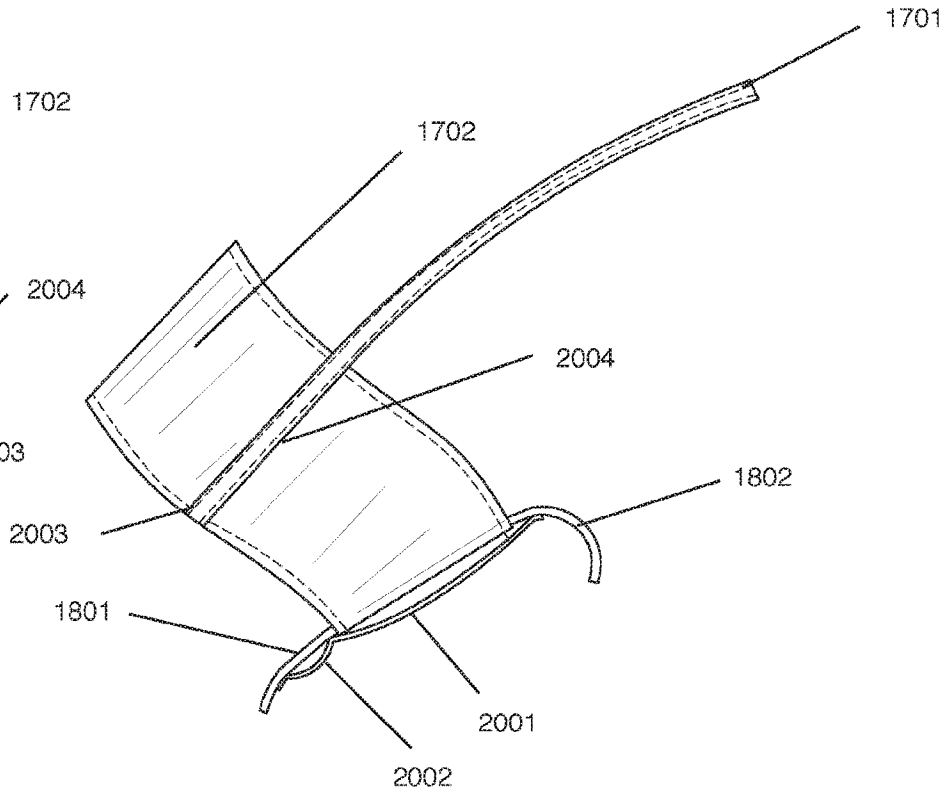
FIG. 20 is a proximal perspective view of an embodiment of the invention.

The counter strap 1701 may join the foot strap 1702 at one or more interfaces. As seen in in FIG. 22, the distal end 2201 of the counter strap 1701 may join the foot strap 1702 at a distal region 2202. As seen in FIG. 20, the proximal end 2003 of the counter strap 1701 may join the foot strap 1702 at a proximal region 2004. In one embodiment, the distal end 2201 and proximal end 2003 may join in one interface or region. The variances in the number interface regions may depend on decisions regarding style and comfort.

Figure 22:
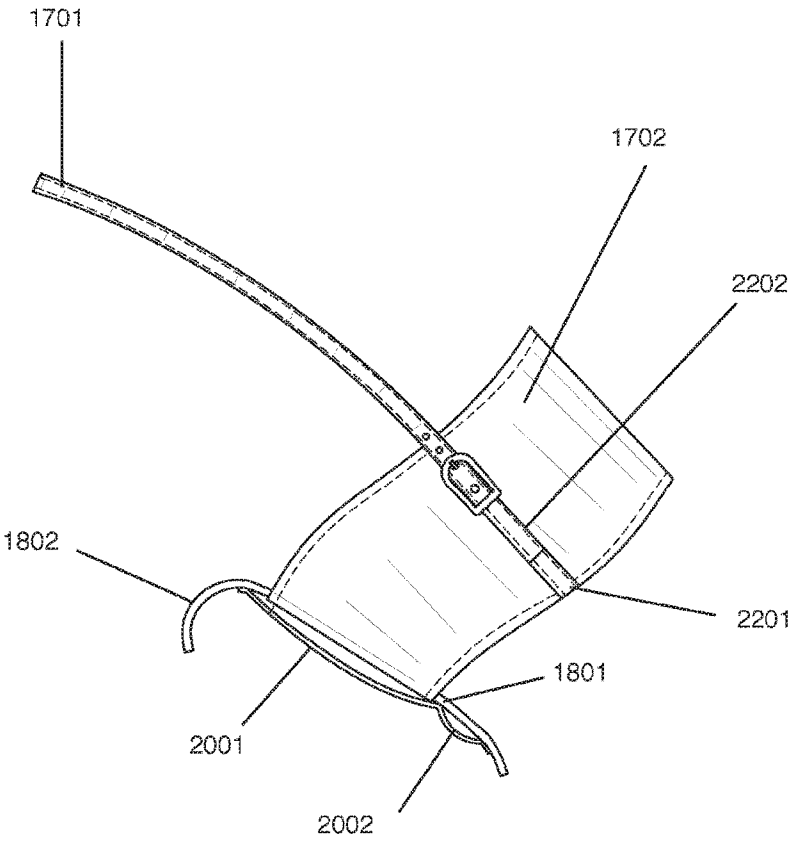
FIG. 22 is a left side elevation view of an embodiment of the invention.

Different mechanisms may be used to join counter strap 1701 with the foot strap 1702 at the interface region. This may include, but is not limited to, sewing, hook and loop, buckles, buttons, and/or snaps. The mechanism joining the counter strap 1701 and the foot strap 1702 to the interface may be different for the distal end 2201 and second slot 2002, as seen in FIG. 22 and FIG. 20, respectively.

The counter strap 1701 may be removably attachable to the foot strap 1702 at the interfaces. This allows the user to use just the foot strap if desired.

Figure 23:
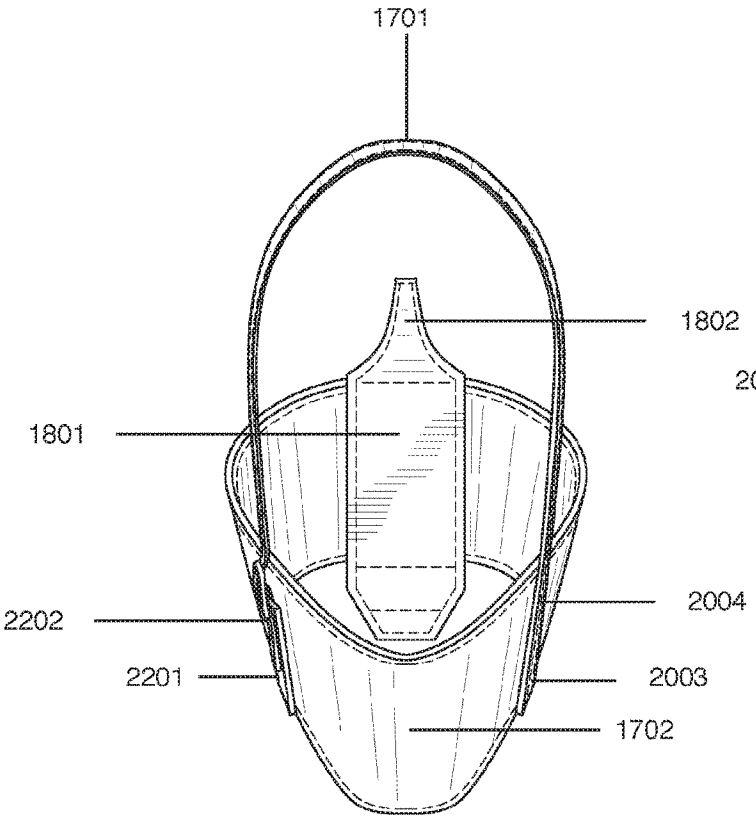
FIG. 23 is a front top perspective view of an embodiment of the invention.

FIG. 23 shows the front top perspective of the strap system as it stands alone without the user's shoe and foot.

Figure 24:
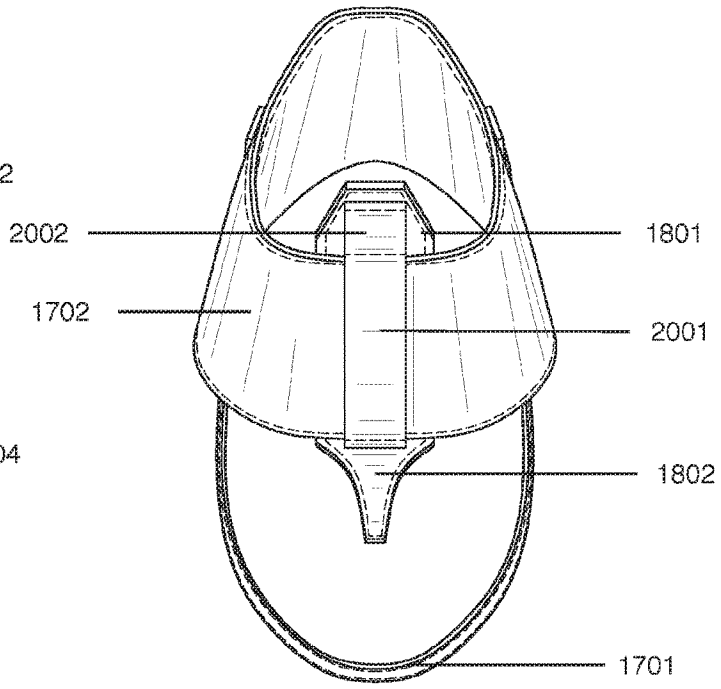
FIG. 24 is a bottom rear perspective view of an embodiment of the invention.

FIG. 24 shows the bottom rear perspective of the strap system as it stands alone without the user's shoe and foot.

Figure 25:
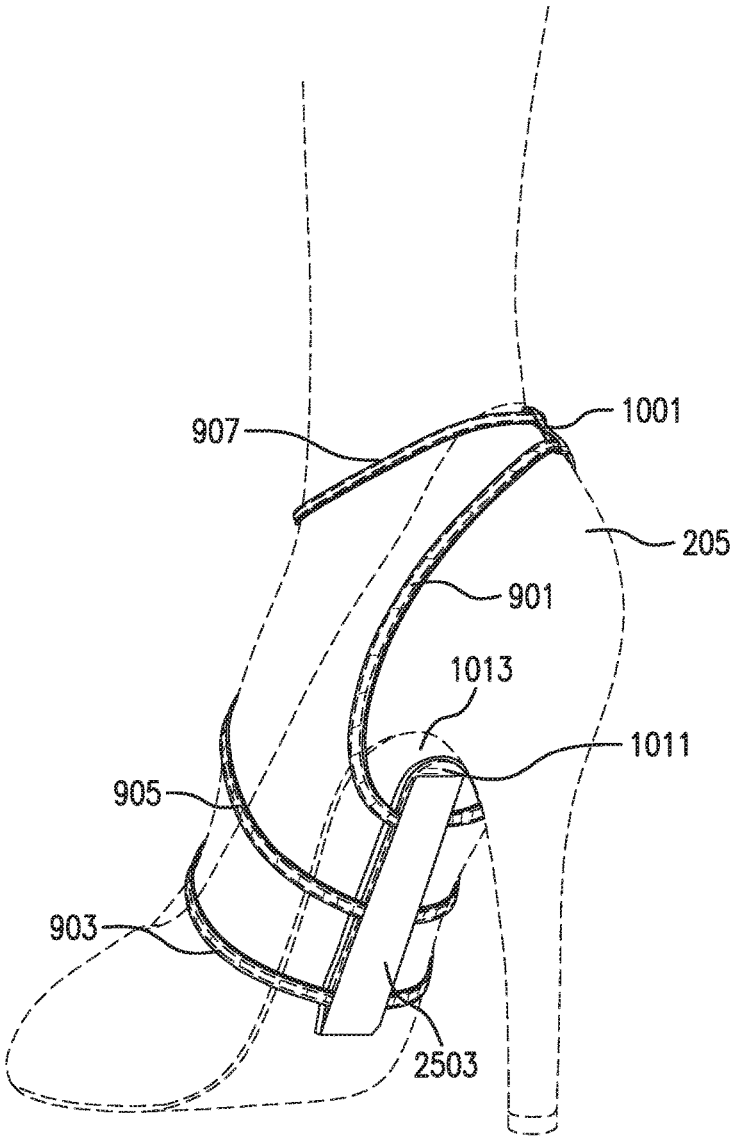
FIG. 25 is a rear perspective view of a right foot configuration of an embodiment of the invention.

FIG. 25 illustrates the bottom perspective view of the securing device, as it would appear on a user's shoe and foot during use. As seen in FIG. 25 the securing device comprises a connector strap 1001 which provides an anchoring position for the counter strap 901 and ankle strap 907 at the counter 205 of a shoe.

FIG. 25 further illustrates a modified baseplate 2503 underlying a shoe. The modified baseplate 2503 is comprised of a top member and bottom member which are permanently attached to one another. According to the embodiment shown in FIG. 25, the counter strap 901, front-strap 903, mid strap 905 are secured to the baseplate 2503. According to an embodiment, one or more of the counter strap 901, front-strap 903, mid strap 905 are permanently secured to the baseplate 2503 using, e.g., adhesive, stitching, nails, screws, etc. According to another embodiment, one or more of the counter strap 901, front-strap 903, mid strap 905 are removably secured to the baseplate 2503 using, e.g., snaps, clips, hook and loop fasteners, etc.

According to an embodiment, the baseplate 2503 can include a wide range of materials such as, e.g., sturdy elastic, hard plastic, metal, etc.

Figure 26:
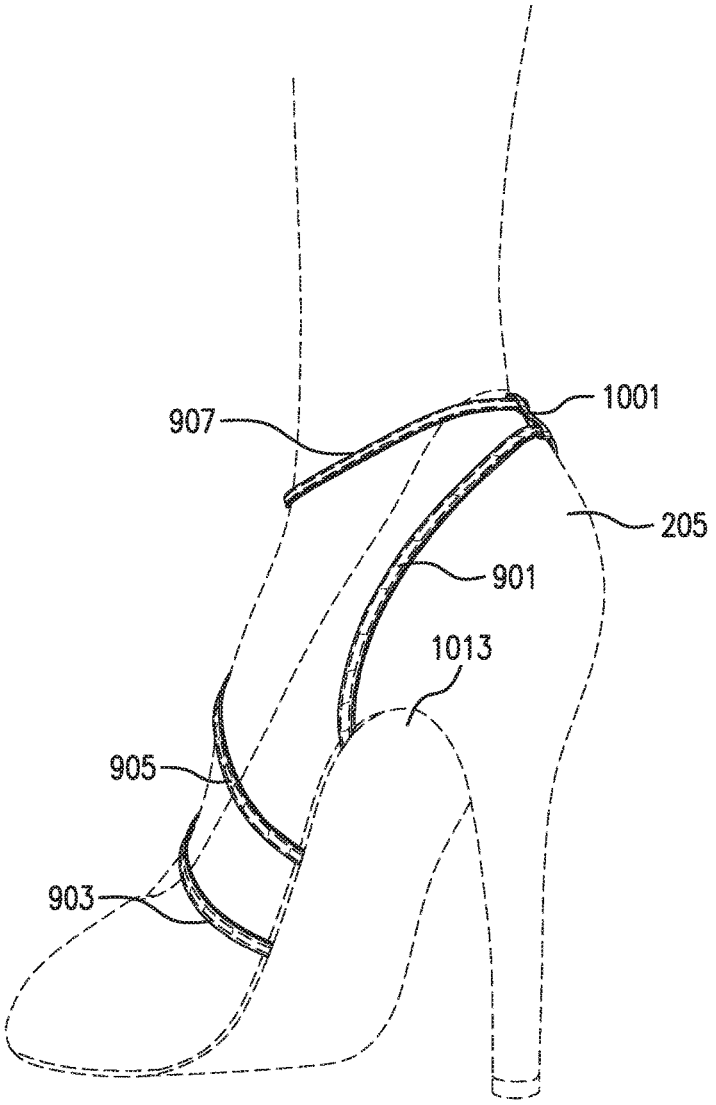
FIG. 26 is a rear perspective view of a right foot configuration of an embodiment of the invention.

FIG. 26 illustrates the bottom perspective view of the securing device, as it would appear on a user's shoe and foot during use. As seen in FIG. 26 the securing device comprises a connector strap 1001 which provides an anchoring position for the counter strap 901 and ankle strap 907 at the counter 205 of a shoe.

According to the embodiment shown in FIG. 26, no baseplate 2503 is applied to the apex 1013 of the shoe. The counter strap 901, front-strap 903, mid strap 905 are secured directly to the apex 1013 of the shoe. According to an embodiment, one or more of the counter strap 901, front-strap 903, mid strap 905 are permanently secured to the apex 1013 of the shoe using, e.g., adhesive, stitching, nails, screws, etc. According to another embodiment, one or more of the counter strap 901, front-strap 903, mid strap 905 are removably secured to the apex 1013 of the shoe using, e.g., snaps, clips, hook and loop fasteners, etc.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A footwear securing device, the device comprising:

a front strap, a mid strap, a rear strap, an ankle strap, a connector strap, and a base plate, wherein the base plate includes a front slot, a mid slot, and a rear slot, the front slot, mid slot, and rear slot being on an underside of the base plate, and wherein the front strap passes through the front slot, the mid strap passes through the mid slot, and the rear strap passes through the rear slot;

the base plate configured to attach to a sole of a shoe; and the front strap, the mid strap, and the rear strap being configured to be coupled to the base plate.

2. The footwear securing device of claim 1, the ankle strap comprising a proximal end and a distal end, the proximal end comprising adjuster holes, the distal end comprising a buckle, the adjustor holes configured to engage with the buckle.

3. The footwear securing device of claim 1, wherein the front strap is configured to rest longitudinally across a dorsal side of a foot; and further comprising:

a top strap comprising a front region, a mid region, and a loop region, wherein the front strap, mid strap, and ankle strap being coupled to the base plate.

4. The footwear securing device of claim 3, wherein the front strap, the top strap, and the ankle strap are permanently coupled to the base plate.

5. The footwear securing device of claim 1, the base plate comprising a front end and a rear end; the rear end of the base plate comprising a curve of at least 20 degrees and the front end of the base plate being approximately flat.

* * * * *